United States Patent [19]

Carr

[11] Patent Number: 4,658,543

[45] Date of Patent: Apr. 21, 1987

[54] SWINGING LIFT GATE

[76] Inventor: Frederick J. Carr, 2101 Refugio Rd., Goleta, Calif. 93117

[21] Appl. No.: 751,520

[22] Filed: Jul. 3, 1985

[51] Int. Cl.[4] ..... E05F 15/00

[52] U.S. Cl. ..... 49/139; 49/25; 49/49; 49/192; 49/340

[58] Field of Search ..... 49/192, 139, 140, 141, 49/35, 49, 25, 26, 340, 28, 394, 357, 327, 328, 329

[56] References Cited

U.S. PATENT DOCUMENTS

| | | | |
|---|---|---|---|
| 391,734 | 10/1888 | Broad | 49/327 |
| 489,469 | 1/1893 | Ellsworth | 49/328 X |
| 798,846 | 9/1905 | Van Pelt | 49/298 |
| 833,216 | 10/1906 | Hunt | 49/192 |
| 896,648 | 8/1908 | Marks | 49/328 X |
| 1,893,824 | 1/1933 | McWhirter | 49/28 |
| 1,910,220 | 5/1933 | Kremser et al. | 49/331 |
| 1,945,295 | 1/1934 | Pranger | 49/192 |
| 2,563,894 | 8/1951 | White | 49/226 |
| 3,024,550 | 3/1962 | Kudera, Jr. et al. | 49/192 X |
| 3,135,062 | 6/1964 | Guerco | 49/192 X |
| 3,678,622 | 7/1972 | Miller | 49/28 |
| 3,975,861 | 8/1976 | Baump et al. | 49/28 |
| 4,231,190 | 11/1980 | Tieben | 49/25 |
| 4,403,449 | 9/1983 | Richmond | 49/139 X |
| 4,416,085 | 11/1983 | Lybecker et al. | 49/340 |
| 4,434,578 | 3/1984 | Rumpz | 49/49 |

*Primary Examiner*—Philip C. Kannan

*Attorney, Agent, or Firm*—Harry W. Brelsford

[57] ABSTRACT

A lift gate has its bearing structure mounted on a post for rotation about a vertical axis to provide lifting and an alternative swing action. Mechanical latches normally keep the gate from swinging. An electrical motor normally lifts the gate and power is maintained by a solar electric panel. The motor can be mechanically disconnected from the gate to provide for manual lifting of the gate when there is a malfunction. A clock mechanism energizes the motor to close the gate after it has been opened for a predetermined time period.

1 Claim, 6 Drawing Figures

SWINGING LIFT GATE

TECHNICAL FIELD

This invention relates to gates for controlling traffic through a fence or other barricade and has particular reference to lift gates and parallelogram lift gates.

BRIEF SUMMARY OF THE INVENTION

The lift gate of the invention has a power mechanism for lifting and lowering the gate. When the gate is located at a remote place I presently prefer electric power supplied by a battery which is maintained in a charged condition by a solar electric panel.

I presently prefer a parallelogram gate wherein uprights are pivoted to horizontal spars as viewed when the gate is closed. The gate is counterbalanced by a tension spring. The electric power mechanism is used to open and to close the gate. Various controls are used to activate the gate power means, including key operated switches, radio controlled switches, manual latches, push button switches, card readers, optical sensors, etc.

If, however, the lifting mechanism fails, the gate can be opened by manually releasing a manual latch on the gate, permitting the gate to swing about a vertical axis. In this fashion we provide a fool-proof gate that can be operated in all eventualities. Additionally the power mechanism can be manually released, so that the gate can be lifted manually.

Various objects, advantages and features of the invention will be apparent in the drawings forming an integral part of this specification in which.

Figure 1:
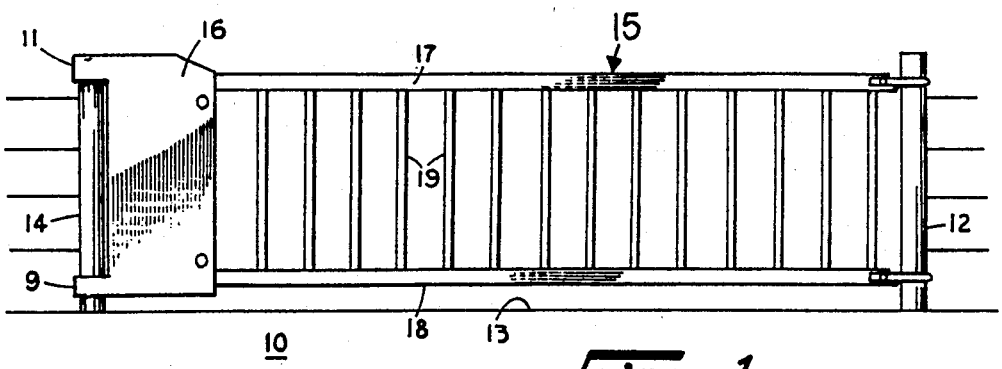
FIG. 1 is an elevation view of my lift gates in a closed condition stopping traffic through an opening in a fence.

Referring to FIG. 1 there is illustrated a section of earth 10 in which is disposed a pair of fence posts 12 and 14 defining between them a driveway or a gateway 13. Disposed on the tope of the upright post 14 is a cap 11 which supports a housing 16 which in turn supports a barrier 15 in the form of a pair of horizontal spars 17 and 18 to which are pivoted vertical members 19. The barrier stops the flow of traffic through the driveway or gateway 13 inasmuch as the posts 12 and 14 are part of a fence or other barricade which prevents the vehicles from passing through the barricade. Disposed at the bottom of the housing 16 is a strap 9 which encircles post 14.

Figure 2:
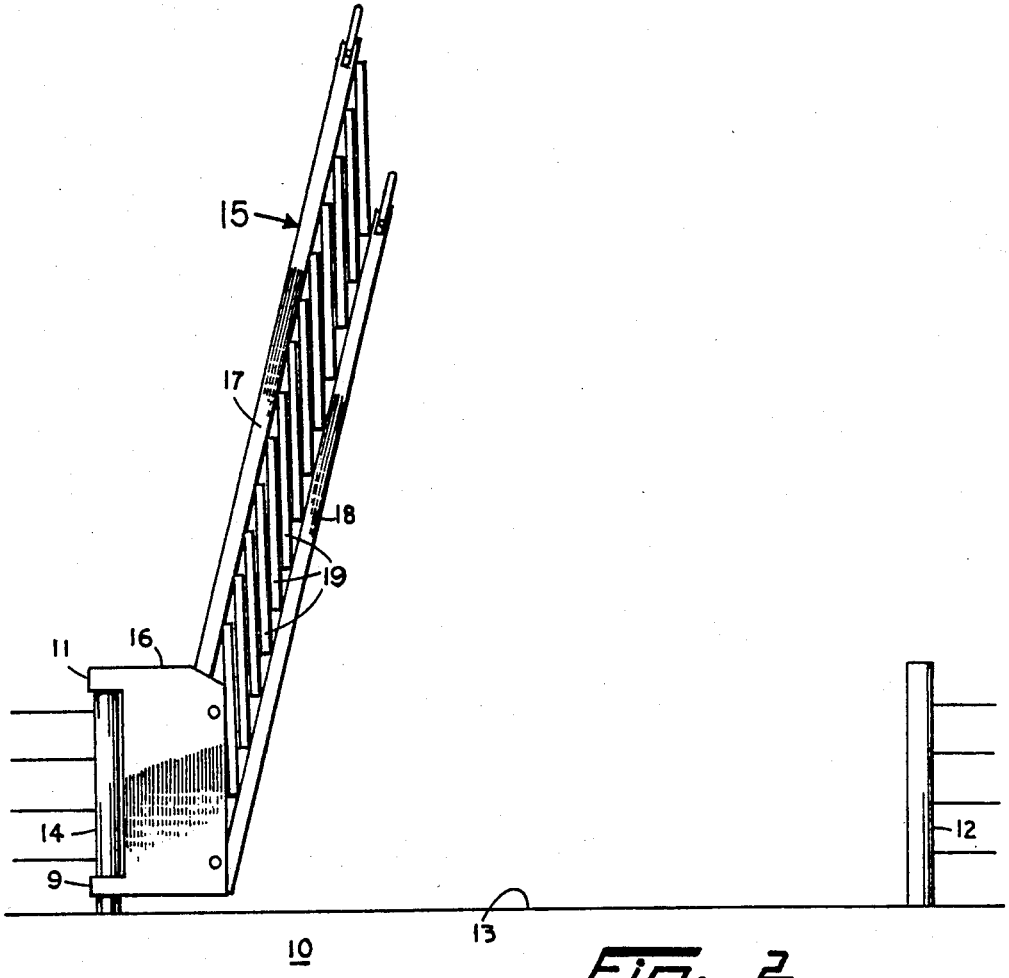
FIG. 2 is an elevation view of the gate of FIG. 1 in an open position.

Referring to FIG. 2 there is illustrated the gate of FIG. 1 in a raised position. Gates of this type are known as parallelogram gates and are particularly advantageous inasmuch as they occupy a small space for shipping when the parallelogram is in a closed position as shown in FIG. 2. Also parallelogram gates eliminate the need for a swing radius permitting use in cramped areas.

Figure 4:
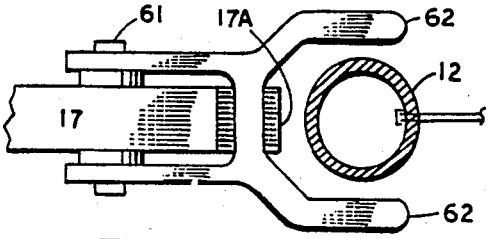
FIG. 4 is a plan view on an enlarged scale of the free end of the gate showing the yoke structure for engaging a fence post.

Referring to FIG. 4 there is illustrated a top view of the right hand end or free end of the upper gate spar 17. Pivoted to the spar 17 by a bolt 61 is a yoke 62 which partly encircles the fence post 12. The downward motion of of the yoke 62 is limited by a projecting portion 17A of spar 17. The yoke 62 may be manually lifted to open the gate when it is used as a swing gate. When the gate is used as a lift gate, no manual operation of the yoke 62 is needed. A similar yoke 62 may be attached to the lower gate spar 18. These yokes 62 maintain the gate in a closed position against the pressure of wind, cattle, persons, etc.

Figure 3:
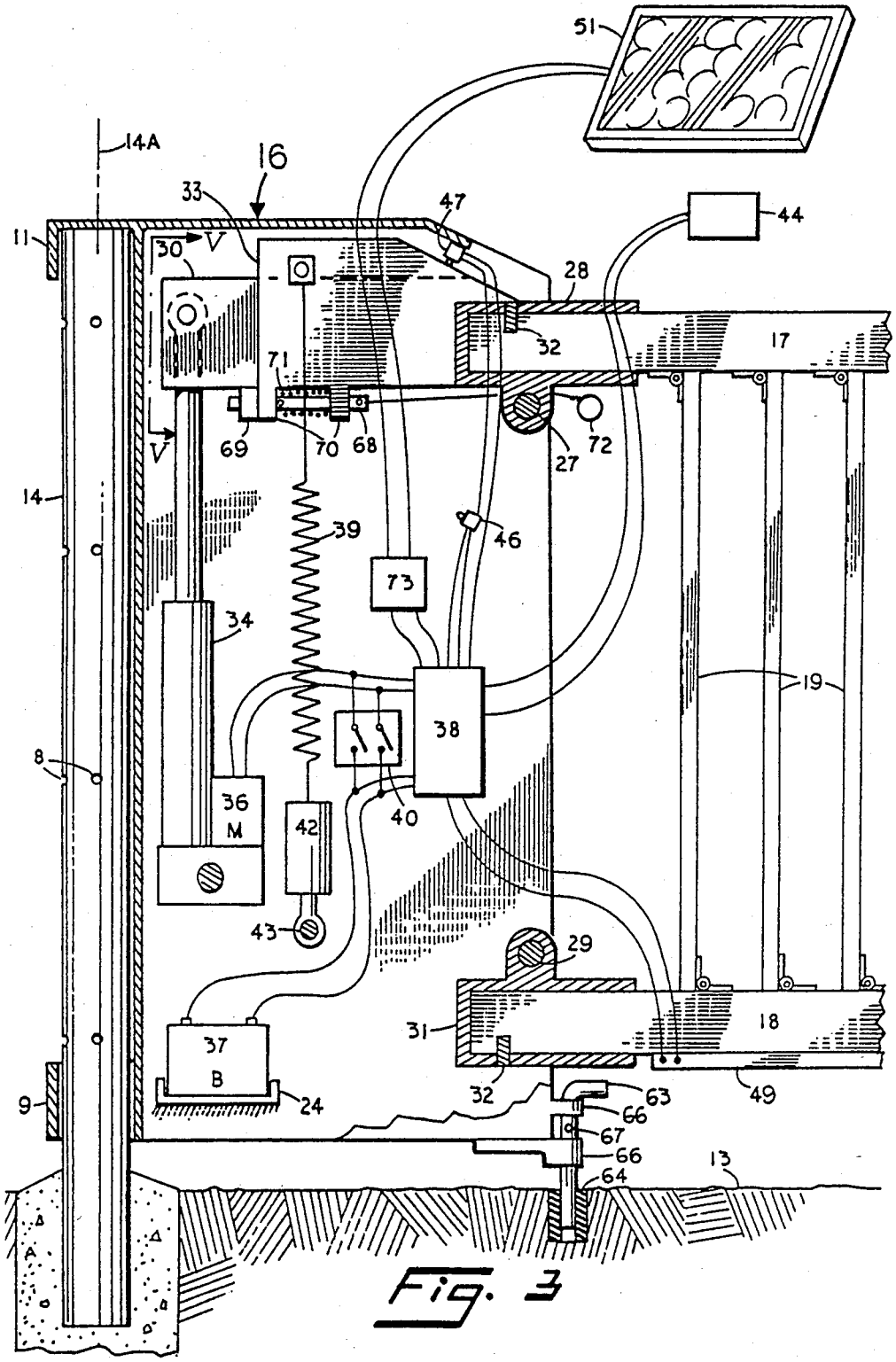
FIG. 3 is an elevation view on an enlarged scale of the interior of the housing at the lift end of the gate of FIGS. 1 and 2, but with the outer cover removed to show the mechanism and elements disposed in the housing.

Referring now to the lower portion of FIG. 3, located at the lower right hand part of housing 16 is a vertical latch pin 63 engaging a ground socket 64 in the driveway 13. The pin 63 is held to the housing 16 in reciprocating relationship by a pair of apertured ears 66 secured to the housing 16. This latch pin 63 holds the gate against swinging action, together with the yokes 62. The lift latch pin 63 may be secured normally against movement by any suitable lock, such as a padlock (not shown) engaging a hole 67.

Referring to FIG. 3 there is illustrated the housing 16 with one cover plate removed to disclose the mechanism inside. The housing 16 is mounted on the vertical post 14 by means of the cap 11 and strap 9. The housing is preferrably made of metal and is preferrably water tight in parts at least in order to protect the mechanisms disposed in the housing. The cap and strap 9 permit the housing to rotate about the post 14 which has a vertical axis 14A. The post 14 has holes 8 or other recessed fittings to which fence wires may be secured.

Referring stil to FIG. 3 it will be noted that the housing has an upper bearing 27 supporting a tubular socket 28 in which is fitted the upper spar 17. This bearing 27 permits rotation of the spar 17 about a horizontal axis. The housing also has a lower bearing 29 connected to a socket 31 in which is fitted the lower spar 18. Suitable pins 32 lock the spars in their respective sockets. Referring now to the upper part of FIG. 3 it will be noted that the socket 28 has a cantilever arm 33 projecting to the left of the bearing 27. Pivoted on bearing 27 also is a second arm 30.

Figure 5:
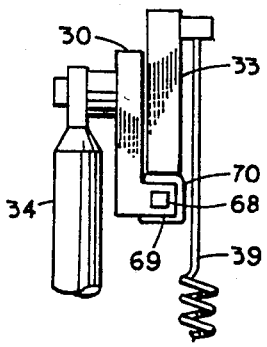
FIG. 5 is a view along the line V—V of FIG. 3 to show the structure for releasing the power mechanism from the gate so that the gate can be lifted manually.

The two arms 30 and 33 are normally held together by a spring pin 68 engaging an apertured lug 69 secured to arm 30. The pin 68 is slidingly held to cantilever arm 33 by apertured ears 70 and is held in engagement with the lug 69 by a compression spring 71. The pin 68 is reciprocated by a pull wire 72 disposed below the upper spar 17. FIG. 5 also shows this pin structure.

Pivoted to the cantilever arm 30 is a linear actuator 34 having its lower end secured to the housing 16 and driven by an electric motor 36. Motor 36 receivers electrical current from a battery 37 the flow of which is controlled by a controller 38. When the controller 38 passes current in one direction the motor shortens the linear actuator 34 and when current flows in an opposite direction then the motor 36 lengthens the actuator to the position as shown in FIG. 3. The entire weight of the barrier and its connected parts is counterbalanced by a spring 39 having one end connected to the cantilever arm 33 and having its other end connected through an adjuster 42 to the housing at 43.

Referring still to FIG. 3 there is illustrated in the upper right hand part an operator 44 which initiates the movement of the gate and this can be in various forms for example, a push-button switch, a key switch, a card reader, an intercom actuator switch, digital key-less switch, an optical sensor for cards, a voice-print sensor, a remote radio controller, such as used on garage doors, a loop detector of other suitable mechanisms that are operated by the person wishing the gate to open so that traffic can pass over the driveway 13. The operator 44 closes and opens relays in the controller 38 to operate the gate.

In the event of relay failure a direct acting manual switch 40 is provided to obtain power operation of the gate, and is shown in FIG. 3.

It will be noted that the operator 44 as well as the battery 37 are connected to the controller 38. Also connected to the controller 38 is a limit switch 46 in the center part of FIG. 3 which limit switch is contracted by the arm 33 when the gate is lifted. In the position shown in FIG. 3, arm 33 has contacted a limit switch 47 to open it to send a signal to the controller 38 to stop the operation of the motor 36. When the barrier 15 is in the upper position shown in FIG. 2 then the arm 33 will contact the limit switch 46 to stop upward movement of the barrier. Disposed on the bottom edge of the lower spar 18 is a safety switch 49 in the form of a long strip for the entire length of the spar 18 and this in turn is also connected to the controller 38. When the barrier 15 is descending from an upright position and an automobile or other object is in the driveway 13, the object will be contacted by the safety switch 49 which sends a signal to the controller 38 to stop and reverse the motor 36 to again lift the gate.

Referring to the upper right hand part of FIG. 3 there is disclosed a panel 51 of photovoltaic cells which generate electricity when the sun's rays strike the panel. This solar panel is connected by wires to a voltage regulator 73 which delivers current to the controller 38 which allows current to flow from the panel 51 to the battery 37 to charge the battery. The solar panel 51 is preferrably of sufficient size so that it can maintain the battery 37 in a charged condition for the normal use of the gate.

Figure 6:
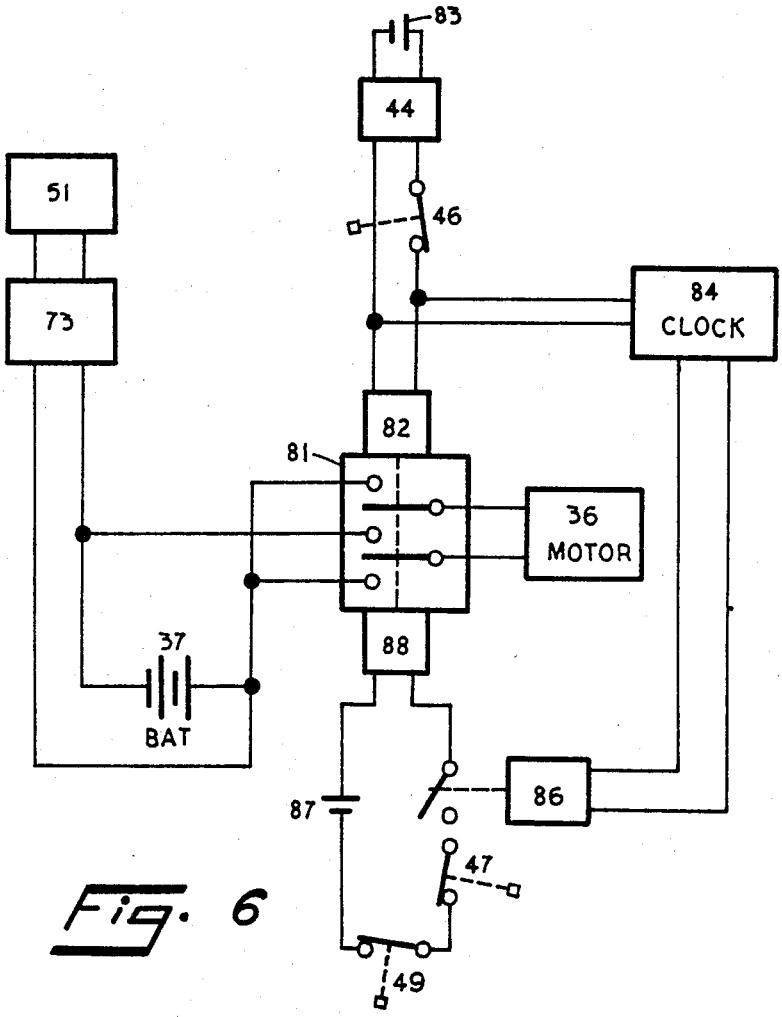
FIG. 6 is a functional schematic circuit diagram showing a circuit for operating the motor of the lift and lowering mechanism.

Referring to FIG. 6, there is illustrated a highly schematic functional diagram of the simplified operations shown by box 38 on FIG. 3. The motor 36 is connected to a double acting reversing relay 81 which does not conduct current in its rest position. The battery 37 supplies power current to the relay 81. A relay coil 82 is connected to the operator switch 44 and receives current from a source 83. The gate is normally closed, and when operator switch 44 is closed coil 82 actuates the relay to cause motor 36 to lift the gate. This continues until the cantilever arm 33 strikes the limit switch 46 which opens the circuit to coil 82 and the relay becomes non-conducting.

This cessation of current to coil 82 energizes a clock 84 which after a pre-set time period delivers a signal current to the coil of relay 86 which closes a circuit through a current source 87 that energizes the reversing coil 88 of the power relay 81. Relay 81 thereupon causes motor 36 to reverse which closes the gate until cantilever arm 33 strikes limit switch 47. This opens relay 81 and the motor stops. If however, there is an object in the driveway 47, then switch 49 on the bottom spar 18 will open causing the motor to stop. A suitable reversing mechanism (not shown) causes the gate to again lift and after the selected time period, to close again.

FIG. 6 is highly schematic and the actual structure of controller 38 includes a number of relays and a printed board circuit. Panel 51 charges battery 37.

OPERATION

Assuming that the gate is closed as shown in FIG. 1 and it is desired to open the gate, an operator closes the control switch 44 in the upper right hand part of FIG. 3 by means of a push-button, key switch, control switch, etc. whereupon this message is delivered to the controller 38 which then connects the motor 36 to the battery 37. The motor 36 then causes the linear actuator 34 to shorten whereupon the actuator pulls on arm 30 to rotate the upper spar 17. The upper spar 17 is connected by the vertical cross members 19 to the lower spar 18, and accordingly both spars 17 and 18 rotate in unison until the upper position is achieved as shown in FIG. 2. When this amount of rotation takes place the limit switch 46 will be contacted by the cantilever arm 33 and this will open switch 46 which sends a message to the controller 38 to stop the motor 36. The controller 38 also has a clock mechanism disposed therein to reverse the motor 36 after a pre-determined length of time, for example, one minute whereupon the motor will lengthen the linear actuator 34 and cause the barrier 15 to go the horizontal position shown in FIG. 1. This clock-wise movement as viewed in FIG. 1 will stop when the cantilever arm 33 strikes limit switch 47. The closing of the switch 47 delivers a control signal to the relays in controller 38, stopping the motor 36.

If, referring to FIG. 3, however, the mechanism fails to work either from lack of electricity or other malfunction, then a person who desires to open the gate can manually pull on the wire 72 below the upper spar 17 to move the latch pin 68 to the right. This latch pin 68 to the right pulls it out of the hole in lug 69 connected to the pivot arm 30. The gate is then free of the actuator 34, but the balance spring 34 remains connected to the cantilever arm 33. A human operator can thereupon manually lift the right end of theg ate as viewed in FIG. 1 until it assumes the position shown in FIG. 2. The spring 39 counterbalances the weight of the gate 15 so that very little manual lift is required.

If there is a malfunction of the controller 38, the gate can be lifted by power by closing the switch 40 to connect the motor 36 to the battery 37.

If for some reason the manual lifting is not possible or for other reason, the gate can be swung open by horizontal movement about the vertical gate post axis 14A. Referring to FIG. 3, a human operator lifts the pin 63 at the lower right hand corner of the housing 16. Referring to FIGS. 1 and 4, the operator next rotates the yokes 62 to a vertical position, freeing the right hand end of the gate from the fence post 12. The operator then manually pushes the gate horizontally about its vertical axis 14A to open the gate. In this fashion the gate can act as a lift gate or a swing gate.

The controller 38 includes a clock which actuates a relay which lowers the gate from its position shown in FIG. 2 after a selected time period; for example, one minute. If a vehicle, cattle, or other object is in the gateway 13, it will be struck by the lower spar 18 along the bottom of which is the pressure sensitive switch 49. When switch 49 is closed by striking an object, it actuates a relay to raise the gate until the same clock mechanism again causes the gate to lower.

It will be appreciated that various modifications, variations, and improvements may be made in the embodiment described. For example, the housing 16 may be latched to the post 14 as a substitute for the lift pin 63. The mechanism described is the presently preferred embodiment as required by the statutes. The following claims, therefore, include all such modifications and variations that fall within the true spirit and scope of the invention.

I claim:

1. A lift gate mechanism comprising:

(a) means defining a bearing for rotation about a horizontal axis;

(b) a gate spar mounted for rotation about said horizontal axis;

(c) a cantilever arm connected to said gate spar;

(d) a counterbalance connected to said cantilever arm;

(e) an actuator arm mounted for rotation about said horizontal axis;

(f) an actuator normally connected to said actuator arm for rotating the actuator arm about said horizontal axis;

(g) and a releasable latch normally connecting the actuator arm to the cantilever arm, whereby releasing said latch permits manual movement of the gate spar about said horizontal axis.

* * * * *